358-86

10/7/86 XR 4,616,214 SR

United States Patent [19]

Naito

[11] Patent Number: 4,616,214

[45] Date of Patent: Oct. 7, 1986

[54] SECURITY SYSTEM

[75] Inventor: Akihiko Naito, Tokyo, Japan

[73] Assignee: Pioneer Electronic Corp., Tokyo, Japan

[21] Appl. No.: 381,658

[22] Filed: May 25, 1982

[30] Foreign Application Priority Data

May 27, 1981 [JP] Japan ..... 56-81621

[51] Int. Cl.[4] ..... G08B 1/08

[52] U.S. Cl. ..... 340/533; 340/504; 340/505; 340/506; 340/531; 358/86; 455/3; 375/36

[58] Field of Search ..... 340/533, 531, 538, 502, 340/506, 503, 504, 505, 825.06, 825.07, 825.08, 825.29; 375/36; 358/86, 84, 114; 455/2, 3, 4, 5, 6

[56] References Cited

U.S. PATENT DOCUMENTS 3,713,142 1/1973 Getchell ..... 340/505
3,737,858 6/1973 Turner et al. ..... 358/84
3,866,206 2/1975 DeGiorgio et al. ..... 340/504
3,914,692 10/1975 Seaborn Jr. ..... 340/502
4,148,021 4/1979 Watanabe ..... 340/505
4,361,730 11/1982 Barber et al. ..... 455/5

OTHER PUBLICATIONS

"Exploration of Future CATV", published by Broadcast Journal Company, Feb., 1973.

*Primary Examiner*—Donnie L. Crosland
*Attorney, Agent, or Firm*—Sughrue, Mion, Zinn, Macpeak & Seas

[57] ABSTRACT

A CATV system includes a security system incorporated therein through which a subscriber can automatically or manually transmit various warning or emergency signals to the CATV base station. Apparatus at the base operates to determine the type of warning signal received, and transmits a corresponding confirmation signal to the particular home unit. An indicator on the unit gives a visual indication of the receipt of the corresponding confirmation signal.

4 Claims, 2 Drawing Figures

SECURITY SYSTEM

BACKGROUND OF THE INVENTION

The present invention relates to a security system including a single base unit and a plurality of security terminals, in which the individual security terminals are centrally controlled by the base unit.

Recently, security systems have been developed in which a plurality of security terminals provided in individual houses, offices, etc. are connected through cables to a base unit, and the occurrence of abnormal conditions, such as a fire, a trespasser, etc. are reported to the base or central-control center. However, since the conventional security system merely performs one-way data communication in the direction from the security terminals to the base unit to inform the latter of the occurrence of abnormal conditions, it has been impossible for means located at a particular terminal to immediately confirm whether or not the base unit safely received the information sent out from the security terminal. This is an inconvenience for the subscriber. Particularly, in a medical call (requesting the medical aid of a doctor) or in an emergency call (to convey specific comments to a designated place upon the calling a telephone number, for example), it takes a considerably long time to receive a response. During this interval, the subscriber cannot confirm if the base unit has safely received the information he has sent.

SUMMARY OF THE INVENTION

In view of foregoing, it is an object of this invention to provide an improved security system which is capable of quickly confirming the safe receipt at the base of the information sent out from the terminal.

Briefly, and in accordance with the invention, the subscriber of the security system is capable of confirming the safe receipt of the information he or she has sent to the base unit by means of a security terminal which includes a warning signal transmitting section for transmitting a warning signal to the base when an abnormal condition is detected; a confirmation signal receiving section for receiving a confirmation signal issued from the base unit; a comparison section for comparing an output from said transmitting section with an output from the receiving section; and a display section for displaying the confirmation sent from the base unit in accordance with an output of the comparison section.

DETAILED DESCRIPTION OF THE PREFERRED EMBODIMENTS

Figure 1:
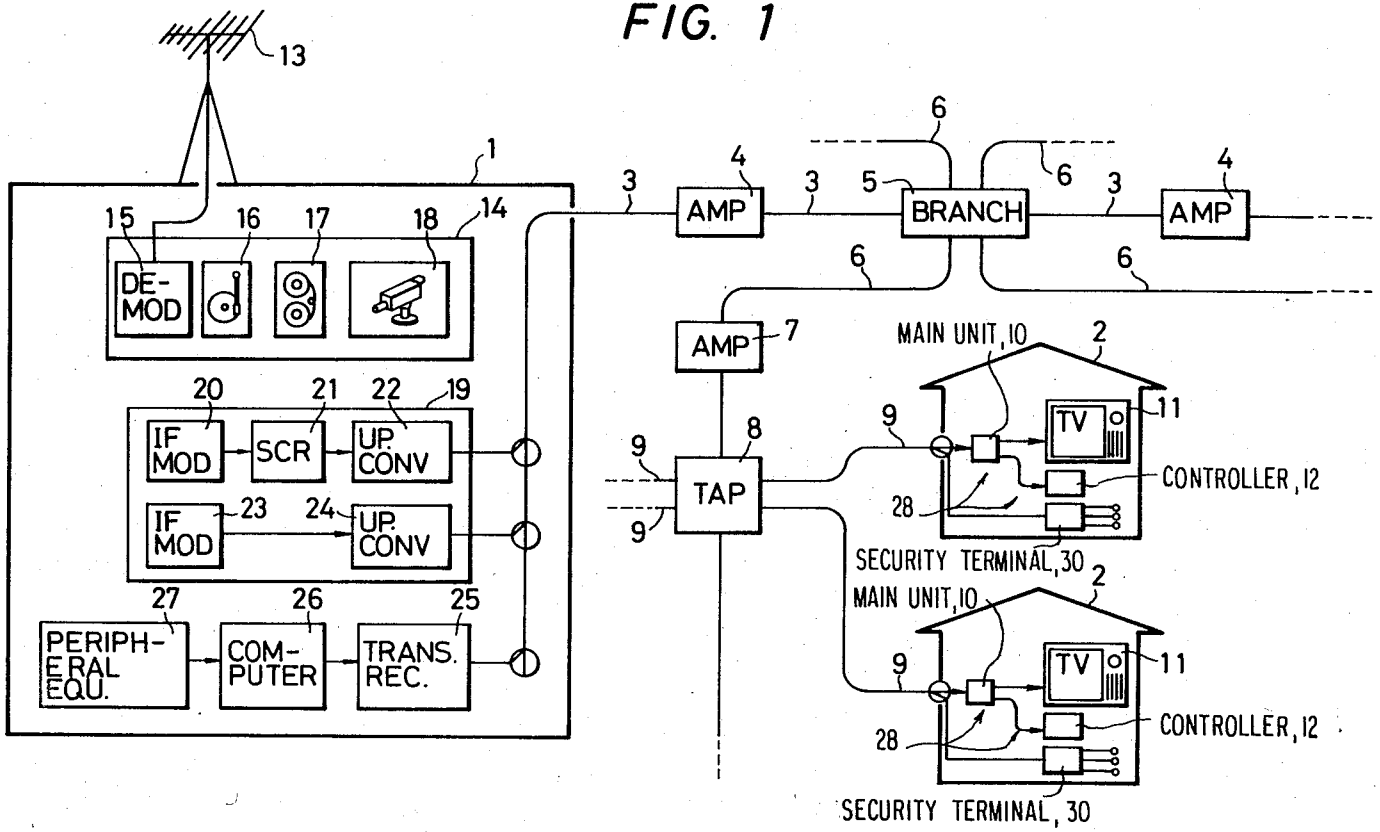
FIG. 1 is an explanatory diagram showing a CATV system to which the present invention is applied.

A preferred embodiment of this invention will now be described with reference to the accompanying drawings. A security system according to this embodiment uses common cables or lines as used in a CATV system.

An outline of the CATV system will initially be described with reference to FIG. 1, in which the CATV system and a security system are included. The CATV system includes a single center or base 1 and terminal units 28 and security terminals 30 which are provided, for example, in several tens of thousands of subscribers' homes 2. The center 1 is connected through coaxial cables to the terminal units 28 and the security terminals 30. A main cable 3 extends from the center 1 and main cable amplifiers 4 and branching units 5 are provided at predetermined positions on the main cable 3. A plurality of branch cables 6 extend from each branching unit 5. Extension amplifiers 7 and tap-off units 8 are provided at predetermined points on the branch cables 6. Each tap-off unit 8 is connected to branch lines 9 which extend to the terminal units 28 in individual homes 2. Each terminal unit 28 includes a main unit 10, a television set 11 and a control unit 12. The branch line 9 is connected to the main unit 10 which is in turn connected to the television set 11 and to the control unit 12. As is apparent from the above description, the main cable extending from the center is branched into a first plurality of branch cables which are further branched into a second plurality of branch lines which are finally connected to the terminal units 28.

A signal receiving antenna 13 is installed outside the base unit 1. The antenna 13 is connected to a demodulator 15 in a source group 14 of the base unit 1. The source group 14 further includes a video disc player 16, a video tape recorder 17 and a studio 18. The output signals of the source group 14 are applied to a modulation output section 19 composed of two systems. One of the two systems includes an IF modulator circuit 20, a scramble circuit 21, and an up-converter circuit 22, while the other system includes an IF modulator circuit 23 and an up-converter circuit 24. The outputs of the up-converters 22 and 23 are connected to the main cable 3, to which a data transceiver 25 is connected for data comunication between the base and each main unit 10. The data transceiver 25 is connected to a computer 26 which is connected to a peripheral unit 27 such as a printer or a display unit.

The operation of the CATV system thus constructed will now be described.

First, the power switch of the television set 11 is turned on. With the television set 11 set to a particular unused channel, the control unit 12 is operated so that the frequency of a desired channel to be received is set to that of the unused channel. The channels which can be selected by the control unit 12 as described above can be classified into three groups of channels for (A) retransmission programs in which television signals from local stations are received without modification, (B) independent programs (free of charge), and (C) chargeable (pay) programs. Each group is allocated ten channels, and therefore any of the thirty channels can be selected by operating the control unit 12.

(A) Retransmission programs

Television signals received by the antenna 13 are demodulated by the demodulator 15 and applied to the modulation output section 19. The signal thus applied is modulated by the IF modulator circuit 23. The frequency of the signal thus modulated is increased to a predetermined frequency by the up-converter circuit 24 according to a determined frequency allocation scheme. That is, it is assigned to a predetermined channel. The resultant signal is applied through the main cable 3, the branch cables 6, and the branch lines 9 to the television sets 11.

(B) Independent programs

The independent programs include locally orginating programs such as weather forecast programs, news programs, and the like. In the case of programs recorded on discs of the video disc player 16 or on the video tape recorder 17 or in the case of live programs produced in the studio 18, the video signal is modulated by the IF modulator circuit 23 and the frequency of the signal thus modulated is increased to that of a predetermined channel by the up-converter circuit 24. The resultant signal is applied to the main cable 3. Reception of these programs is free of charge. That is, the "price" of these programs is included in the basic monthly charge paid by the subscriber.

(C) Chargeable programs

The chargeable programs include new movie programs, special programs, and the like. In the case of programs provided by the video disc player 16 or the video tape recorder 17 or in the case of live programs produced in the studio 18, the video signal is modulated by the IF modulator circuit and is then processed by the scrambler circuit 21 so that the signal cannot be reproduced without special signal processing. Then, the frequency of the signal is increased to that of a predetermined designated channel, and is applied to the main cable 3. In order to receive the chargeable programs, the video signal must be descrambled by the main unit 10 in the subscriber's home 2 so that a regular image appears on the television set 11. The subscriber is charged for the reception of the chargeable programs. That is, predetermined charges therefor are summed, and the user in requested to pay a special charge at a measured rate in addition to the basic monthly charge.

As described above, the base unit or station 1 is connected through coaxial cables to the terminal units in the subscribers' homes 2. However, in order to charge the subscribers for the reception of the chargeable programs, it is absolutely necessary to detect which subscribers receive which channels. That is, it is necessary to detect the channels which have been selected by the subscribers at various times. In order to meet this requirement, a data transceiver 25 outputs a retrieving signal at predetermined time intervals so that the terminal units 28 are called via their assigned address numbers. That is, the channels received by the terminal units at the time of transmission of the retrieving signal are detected, this operation being referred to as "polling." In response to this polling, each terminal unit 28 "answers" the data transceiver 25 with data representative of the channel received by the terminal unit at the time of polling. Various reception and transmission data for the data transceiver 25 are arranged and stored by the computer 26 and are displayed or printed out by the peripheral unit 27. The polling operation is carried out at predetermined time intervals of several seconds to several tens of second and therefore audience ratings can be readily calculated.

Sometimes, the subscribers may participate in the production of programs. In this case, by operating the control units 12, they can answer questions proposed in a program or the like while watching the television sets 11. The answers are transmitted through the coaxial cables to the station 1.

Figure 2:
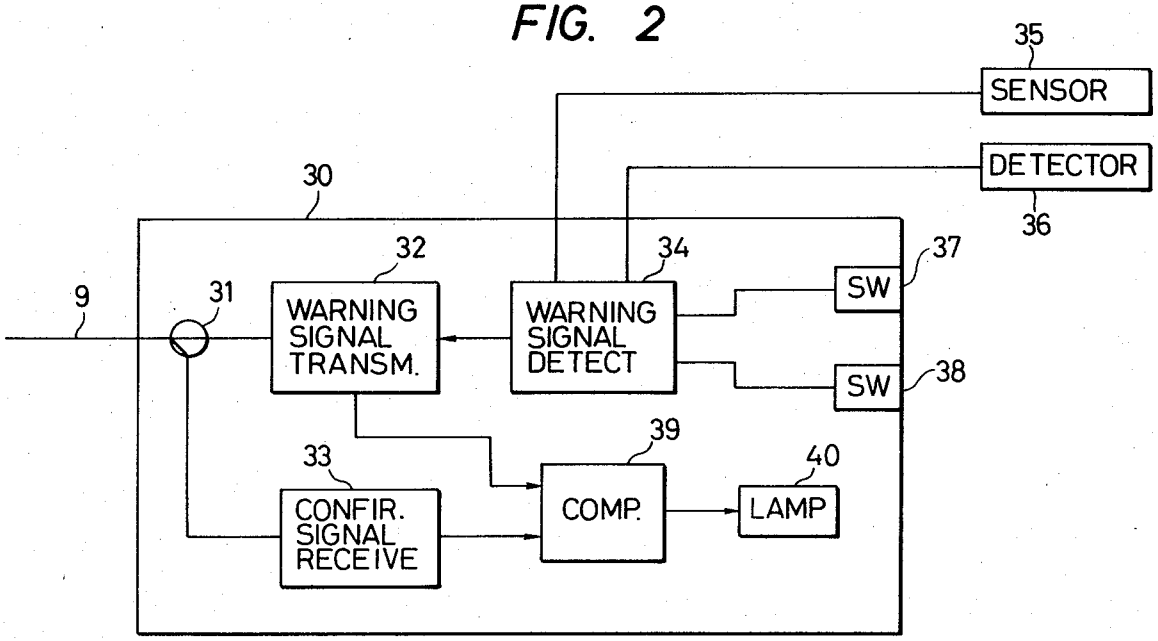
FIG. 2 is a block diagram showing a security terminal according to the invention.

FIG. 2 is a block diagram illustrating the construction of the security terminal 30 appearing in FIG. 1. The branch line 9 extends into the security terminal 30 and is connected to a branching unit 31. A warning signal transmitting section 32 and a confirmation signal receiving section 33 are connected to the branching unit 31. To the warning signal transmitting section 32, a warning signal detecting section 34 is connected. To the latter are connected a fire sensor 35 for detecting the occurrence of a fire, an intruder detector 36, a medical emergency switch 37 for calling a designated doctor, and an emergency switch 38 for conveying information to a specific place. Outputs of the warning signal transmitting section 32 and the confirmation signal receiving section 33 are applied to a comparison section 39. The output of the comparison section 39 is connected to a lamp 40.

The operation of the thus constructed security system will now be described.

Should a fire occur in a subscriber's house, the heat or fire sensor 35 senses the occurrence of the fire and transmits a signal indicative of the occurrence of the fire to the warning signal detecting section 34. Should an unauthorized intruder enter into a house, the detector 36 detects the entrance of the intruder and transmits such fact to the warning signal detecting section 36. In case one requires medical aid due to an urgent sickness, for example, the medical switch 37 is depressed. In order to convey certain comments to a specific person from, for example, an aged person's house, the emergency switch 38 is depressed by the subscriber. By the depression of such switches, corresponding information is delivered to the warning signal detecting section 34 where, upon conversion into specific signal formats, the various kinds of information are fed to the warning signal transmitting section 32. In the signal transmitting section 32, the information thus fed is modulated and sent out to the base 1 through the branch line 9, thereby informing the same of the occurrence of an abnormal condition at the location of the security terminal 30. Upon receiving the warning signal sent out from the security terminal 30, the station 1 determines the content of the warning signal by means of the computer 26 disposed therein and acts on the warning signal. If, for example, the warning signal is indicative of the occurrence of a fire, the center 1 acts to communicate with a firehouse and informs the latter of the occurrence of the fire in the vicinity of the security terminal 30.

The warning signal is also applied to the comparison section 39 while the warning signal transmitting section 32 transmits the warning signal to the center 1. In this case, the lamp 40 is made to flash, thereby indicating that the security terminal 30 is presently sending out the warning signal to the center 1. When the center 1 receives the warning signal thus sent out from the security terminal 30, the computer 26 produces a receipt signal which in turn causes the data transceiver 25 to issue a confirmation signal indicating safe receipt of the warning signal from the security terminal 30. The confirmation signal receiving section 33 receives the confirmation signal thus issued therefrom, and the latter is applied to the comparison section 39 where the confirmation signal and the output of signal transmitting section 32 are subjected to comparison. As a result of the comparison, if it is determined that the two signals correspond (e.g. the warning signal is indicative of the occurrence of a fire and the confirmation signal received from the base is one confirming the safe receipt of the fire warning signal), the comparison section 39 produces a coincidence signal to the lamp 40 to thereby light the same continuously. Therefore, the light 40 informs the subscriber that a confirmation has been issued from the station. If the output signal from the warning signal transmitting section 32 and the confirmation signal from the center 1 do not correspond to each other, the output of the comparison section 39 is not produced. Thus, the lamp 40 continues to flash on-and-off.

The comparison section 39 compares the warning signal from the warning signal transmitting section 32 with the confirmation signal from the confirmation signal receiving section 33 and generates an output dependent upon the correspondence between the warning signal and the confirmation signal. The comparison section 39 controls the operation of the lamp 40. Namely, it controls the lamp 40 to flash when it receives the warning signal without receiving a correspondence confirmation signal and it controls the lamp 40 to be lit continuously when the comparison section 39 determines that the confirmation signal corresponds to the warning signal.

As is apparent from the foregoing description, in the security system according to the invention, the subscriber can immediately confirm that the center 1 has received the warning signal transmitted via the security terminal, which is of great value to the subscriber.

What is claimed is:

1. A security system, comprising:

a plurality of security terminals, said terminals being connected to a monitoring center so as to permit bidirectional data communication therebetween, each of said plurality of security terminals comprising means for transmitting a warning signal to said monitoring center when an abnormal condition is detected at said security terminal; means for receiving a confirmation signal issued from said monitoring center; and display means responsive to the transmitting means and the receiving means, operating in response to both the transmitting of said warning signal only by said each security terminal and the receiving of said confirmation signal for displaying a response from said monitoring center.

2. A system as claimed in claim 1, said warning signal transmitting means being operable to transmit one or more types of warning signals.

3. A system as claimed in claim 2, further including comparing means for comparing an output of said transmitting means with an output of said confirmation signal receiving means, and for generating an output according to the correspondence between said transmitted warning signal and said received confirmation signal.

4. A system as claimed in claim 1, said monitoring center including transceiver means, and computer means for generating a response to said warning signal.

* * * * *